US005689868A

United States Patent [19]

Hartmann

[11] Patent Number: 5,689,868

[45] Date of Patent: Nov. 25, 1997

[54] SPRINGLESS CLASP FOR WATCHBAND OR BRACELET

[76] Inventor: György Hartmann, Klopka u. 79, H-2084 Pilisszentiván, Hungary

[21] Appl. No.: 680,036

[22] Filed: Jul. 15, 1996

[51] Int. Cl.[6] ..... A44C 5/20

[52] U.S. Cl. ..... 24/685; 24/191

[58] Field of Search ..... 24/685, 163 R, 24/265 WS, 265 B, 168, 170, 180, 191

[56] References Cited

U.S. PATENT DOCUMENTS

| | | | |
|---|---|---|---|
| 4,296,532 | 10/1981 | Ho | 24/265 WS |
| 4,675,955 | 6/1987 | Nakamura | 24/68 J |
| 5,152,693 | 10/1992 | Matsui et al. | 24/68 J |
| 5,191,685 | 3/1993 | Aoki et al. | 24/68 J |

FOREIGN PATENT DOCUMENTS

| | | | |
|---|---|---|---|
| 690753 | 6/1965 | Italy | 24/191 |

*Primary Examiner*—James R. Brittain

*Attorney, Agent, or Firm*—Donald A. Bergquist

[57] ABSTRACT

A closure for connecting a first and a second free end of a band such as a watch strap that in use is maintained in tension by hoop stresses imposed on the band by the banded object, the closure including a first clasp element having a first hook member and a second, oppositely-directed and shorter hook member, and a separable second clasp element having first and second hook-engaging members for slidably and releasably engaging said hook members such that the engagement of both hook members with their respective hook-engaging members is possible only by first engaging the first hook member with the corresponding hook-engaging member, sliding the first hook-engaging member deep into the throat of the first hook member, then engaging the second hook member with the second hook-receiving member while partially disengaging the first hook-engaging member from the first hook member, wherein said opposing tensions acting through the first and second clasp elements maintain complete engagement of the second hook while the partial engagement of the first hook maintains the first and second elements in dose alignment.

9 Claims, 4 Drawing Sheets

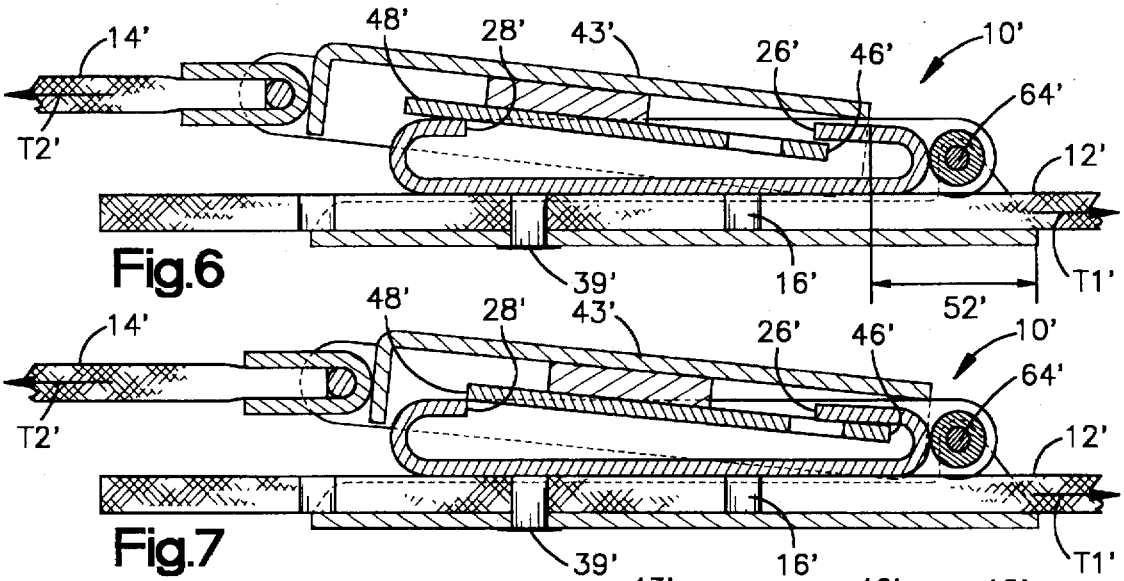
Fig.6
Fig.7
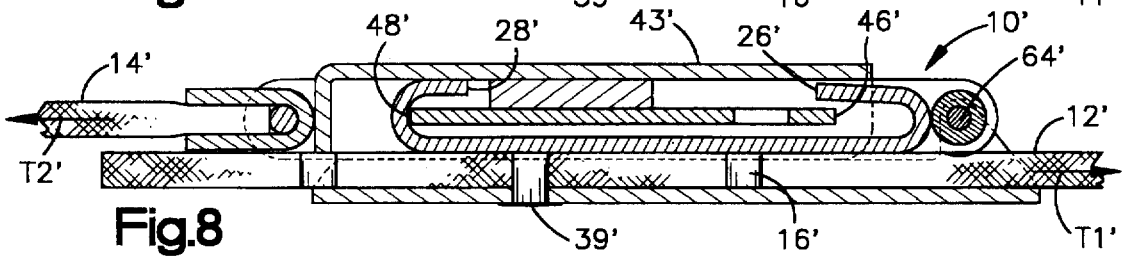
Fig.8
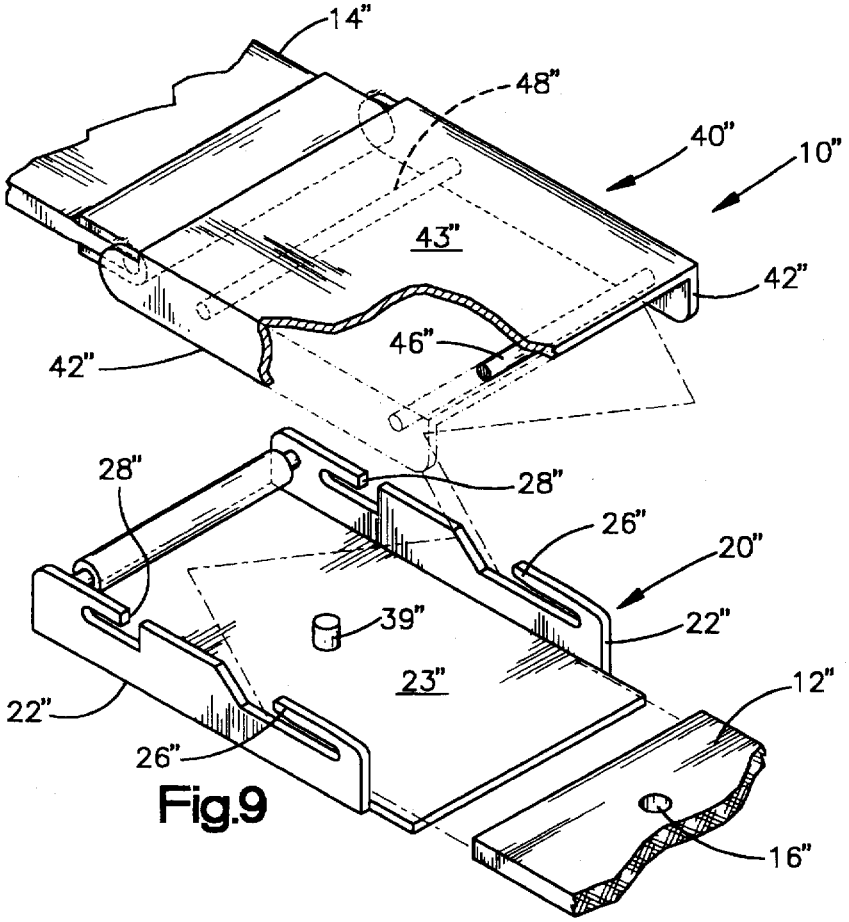
Fig.9

SPRINGLESS CLASP FOR WATCHBAND OR BRACELET

BACKGROUND OF THE INVENTION

1. Field of the Invention

The present invention relates generally to clasps for ornamental items, such as watch bands, bracelets, necklaces and like articles, and pertains more specifically to a clasp wherein no spring biasing means nor snugly fitting members are employed; rather, the tension in the band is used to keep the clasp closed. The invention could also relate to clasps or buckles for belts, harnesses, or other apparatus employing straps to be releasably joined and wherein tension is always present in the straps to be joined. The invention will be described in the context of a watch band.

Generally, this invention may be used with a leather strap, a mesh band, or a band made of multiple links joined on pivot axes that are substantially parallel to the width of the band, thereby providing flexibility to allow the band to wrap around the wrist of the wearer and also providing adjustability by the adding or the removing of links.

2. Description of the Prior Art

Many clasps for ornamental items rely on spring tension or compression or on the compressive elasticity of elements that fit snugly together either to retain the principal latch mechanism or to retain a cosmetic cover that hides the workings of the latch mechanism. With time and repeated use, many such clasps fail because of wear or permanent deformation of the spring means. Although some clasps continue to function, they may become a nuisance because of the failure of the cosmetic cover to stay in place owing to wear or permanent deformation of their retaining means.

SUMMARY OF THE INVENTION

Thus it is an object of the present invention to provide a springless clasp for joining two free ends of a band as might be used as a strap on a wrist watch wherein in use said closure is maintained in tension, said closure comprising a first clasp element having a first elongated hook member and a second, oppositely-directed and shorter elongated hook member, a separable second clasp element having a first hook-engaging member for slidably and releasably engaging said first hook member and, spaced away from said first hook-engaging member, a second hook-engaging member for releasably engaging said second hook member, wherein opposing tension vectors acting through said first and second clasp elements maintain complete engagement of said second hook while the engagement of said first hook maintains said first and second elements in close alignment.

It is an object of this invention to provide such a springless clasp wherein said hook members are a part of a cover and said hook-engaging members are a part of a base.

It is an object of this invention to provide such a springless clasp wherein said hook members are a part of a base and said hook-engaging members are a part of a cover.

It is an object of this invention to provide such a springless clasp wherein the two opposing hook elements are of unitary construction.

It is an object of this invention to provide such a springless clasp wherein each said hook member is formed by cutting a shaped slot into a sidewall of one of said clasp elements.

It is an object of this invention to provide such a springless clasp wherein each said hook-engaging member is a spring pin, the ends of which engage opposing sidewalls of one of one said clasp element.

It is a further object of this invention to provide such a clasp wherein means are provided to create a smooth, finished, and attractive appearance to the clasp when latched.

BRIEF DESCRIPTION OF THE DRAWINGS

This invention will be most easily understood by referring to the figures attached hereto, wherein:

FIG. 6 shows the two elements of the second embodiment of the present invention in partial engagement with the first hook partially engaged.

FIG. 7 shows the two elements of the second embodiment of the present invention in partial engagement the first hook fully engaged.

FIG. 8 shows the two elements of the second embodiment of the present invention in full engagement under tension.

FIG. 9 shows the two elements of a third embodiment of the present invention in a perspective and partial cutaway view to show various parts thereof.

DETAILED DESCRIPTION OF THE PREFERRED EMBODIMENTS

The various figures attached hereto are useful in describing this invention. In these figures, the same part is identified throughout by the use of a unique reference number. Parts that are similar, or have a similar function, but not identical in shape, are referenced by means of a common reference number with a prime (', indicating the first alternative embodiment) or a double prime (", indicating the second alternative embodiment) to distinguish them while still showing their close relationship.

Figure 1:
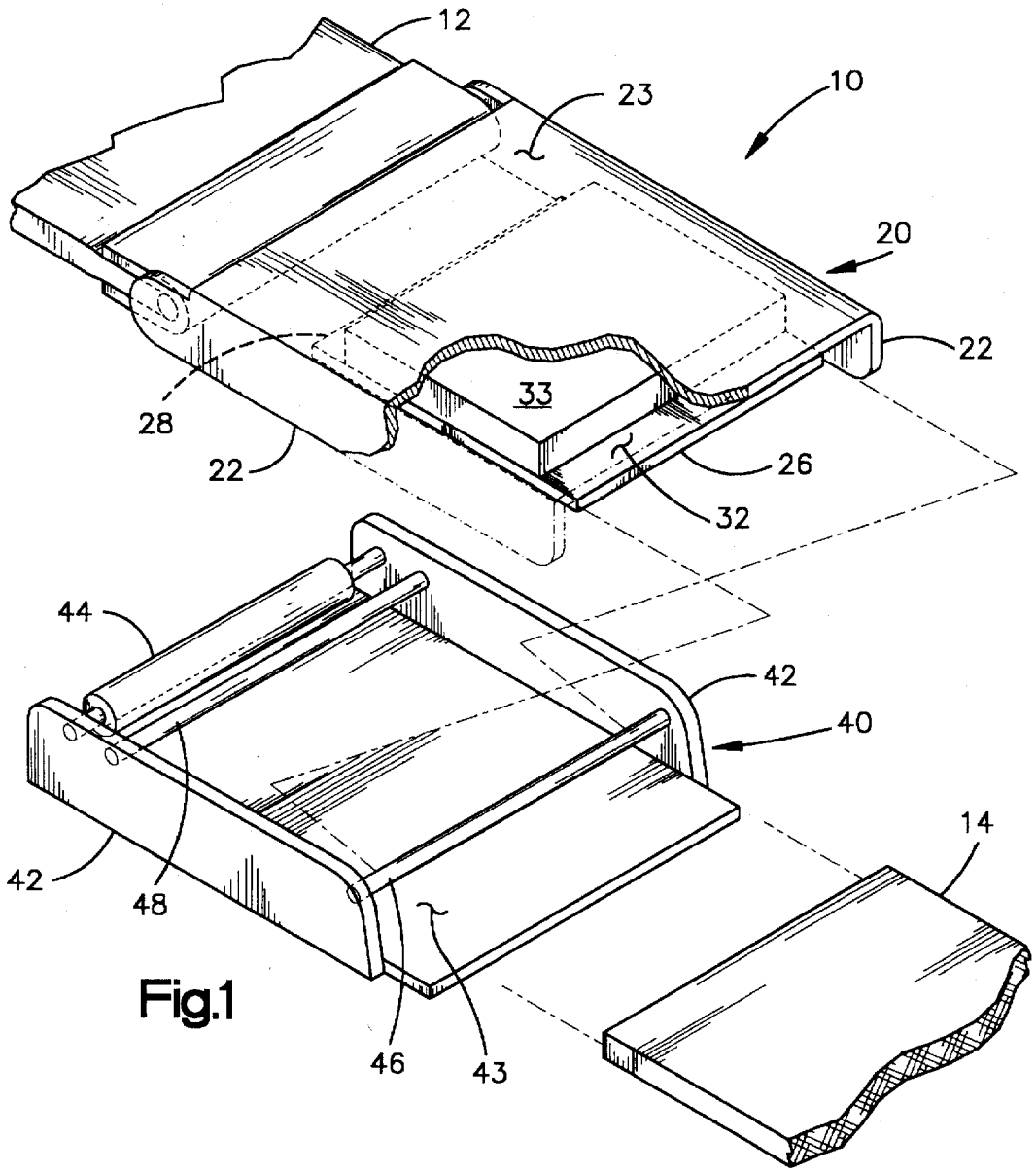
FIG. 1 shows the two elements of a first embodiment of the present invention in a perspective and partial cutaway view to show various parts thereof.

FIG. 1 presents a first embodiment of the present invention in a perspective and partial cutaway view to show various parts thereof. The clasp 10 is shown as a device to join a band having a first free end 12 and a second free end 14 and is made up of two mating parts, a first clasp element 20 connected to said first free end 12 has side walls 22 integral with a top wall 23, thereby to form a cover that provides a neat appearance as it engages and encloses a second clasp element 40 or base that, in use, is connected to said second free end 14. The second clasp element has a flat bottom 43 and opposing side walls 42.

In the illustration showing this embodiment, the first free end is shown hingedly attached to the first element. Such strap attachments are common in the art. The second free end is shown to be held in frictional engagement with a pin 44 and the inside surface of the flat bottom 43 of the second clasp element. Such frictional engagement may be adequate to hold the free end in place, depending upon the material of which the strap is made. A post projecting from the inside surface may be used to engage holes or sockets in the strap for added security. Such a post is shown in illustrating other embodiments 39' 39".

Figure 2:
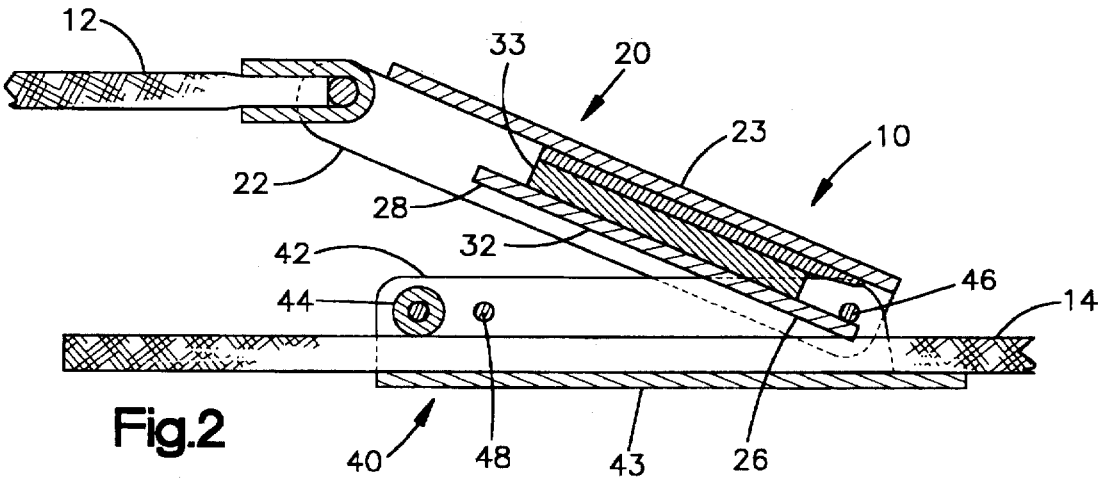
FIG. 2 shows the two elements of the first embodiment of the present invention in partial engagement with the first hook partially engaged.
Figure 3:
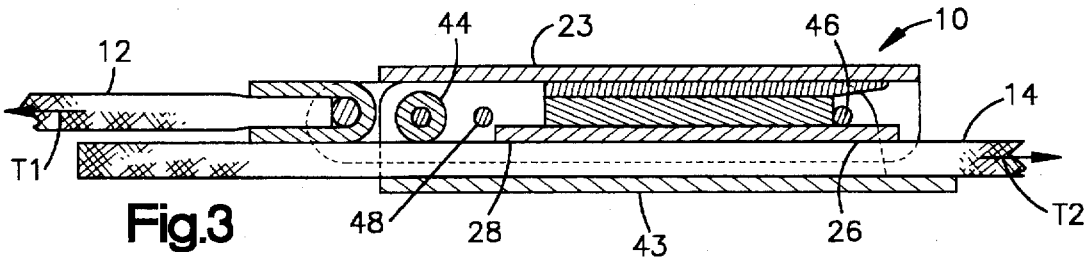
FIG. 3 shows the two elements of the first embodiment of the present invention in engagement, but not under tension.
Figure 4:
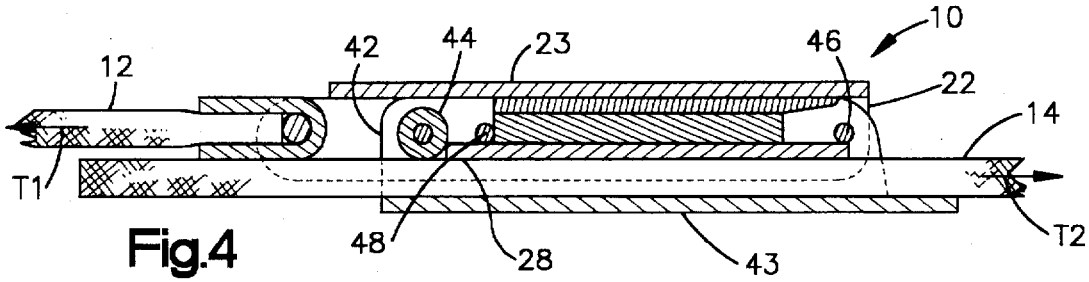
FIG. 4 shows the two elements of the first embodiment of the present invention in full engagement under tension.

These parts of this embodiment are also seen in cross-sectional views as FIG. 2, FIG. 3, and FIG. 4. In this embodiment, two oppositely-directed hook-shaped members, 26 and 28, are formed as a part of the first clasp element 20 by providing a flat plate 32 attached to the underside of said top wall 23 by means of a spacer 33. Although the hooks are formed by a plurality of parts, whereas both are formed from the same plurality of parts, this construction is seen as being two oppositely-directed hooks of unitary construction. This construction forms a wide, flat hook 26 that is especially suited to engaging a wide hook-engaging member, such as a transverse bar or pin.

In the illustrated embodiment, transverse pins 46 and 48 are used as hook-engaging members. Pins 46 and 48 are shown as simple pins fixedly spanning the distance between side walls 42 of the second clasp element 40. Such simple fixed pins are preferred, but the invention could be practiced using removable spring pins engaging holes or sockets in the two side walls 42.

Hook-shaped members having a construction different from what is here shown could be used. The illustrated embodiment is presented for purposes of illustrating the concept only, and the term "hook-shaped member" should not be taken to mean only that which is shown.

The sequence of operations to engage the clasp is illustrated in FIG. 2, FIG. 3, and FIG. 4. In use, the second clasp element 40 usually rests upon the user's wrist or is against some other surface where it is maintained by gravity or friction forces without being gripped; the first clasp element 20 may be held by gripping the opposing side walls 22. The fist clasp element 20 is held inclined to the second clasp element 40 so that the first hook-shaped member 26 may be engaged with the first hook-engaging member 46, as shown in FIG. 2. When the first hook-shaped member 26 is in full engagement with the fist hook-engaging member 46, the first clasp element 20 may be lowered to be in intimate contact with the second clasp element 40, as shown in FIG. 3. Tension in the two free ends in opposing directions will pull the second hook-shaped member 28 into full engagement with the second hook-engaging member 48 while the first hook-shaped member 26 is partially disengaged but not released from the first hook-engaging member 46 because it has a longer length than does the second hook-shaped member 28.

Whereas the direction of the tension vectors in each free end is important in defining this invention, the directions (direction only, not the magnitude) of the tension force vectors are indicated in the figures by arrows T1 and T2. The tension vector T1 representing the tension the first free end 12 exerts on the first clasp element 20 points in the same direction as the opening of the shorter, second hook-shaped member 28. A second tension vector T2 representing the tension acting on and through the second clasp element 40 by the second free end 14 points in a direction opposite to that of the first tension vector T1. The tension represented by these opposing vectors will maintain the clasp in an engaged state by keeping said second hook-engaging member 48 and said second hook-shaped member 28 fully engaged.

Releasing the clasp involves merely reversing the engaging operation. Gripping the first clasp element 20 and applying a force against the tension T1 in the first free end 12 allows the disengaging of the second hook-shaped member 28, thereby permitting the lifting of the first clasp element 20. It will be seen that the operation of all embodiments of this invention involve the same motion to engage the clasp and to disengage the clasp.

It has been found that an important feature of the construction of the clasp mechanism of this invention makes the clasp especially easy to release. The bottom wall 43 of the second clasp element 40 extends a distance beyond the first hook-engaging member 46. This apparently minor feature is important in providing a lever arm 52 sufficient to keep the second clasp element 40 from moving as the first clasp element 20 is lifted to disengage the second hook-shaped member 28 from the second hook-engaging member 48. Without having made a working model, the importance of this feature may not have been observed. Some slight downward force is exerted on the first hook-engaging member 26 as the first clasp element 20 is rotated as it is released. The downward force is transmitted to the bottom of the second clasp element 40, which rests against a surface (usually, the wrist of the wearer). This force, acting on lever arm 52, generates a torque that holds the second clasp element 40 down as the first clasp element 20 is rotated. This concept is repeated in other embodiments included in this disclosure, but becomes more complex in the second embodiment.

Figure 5:
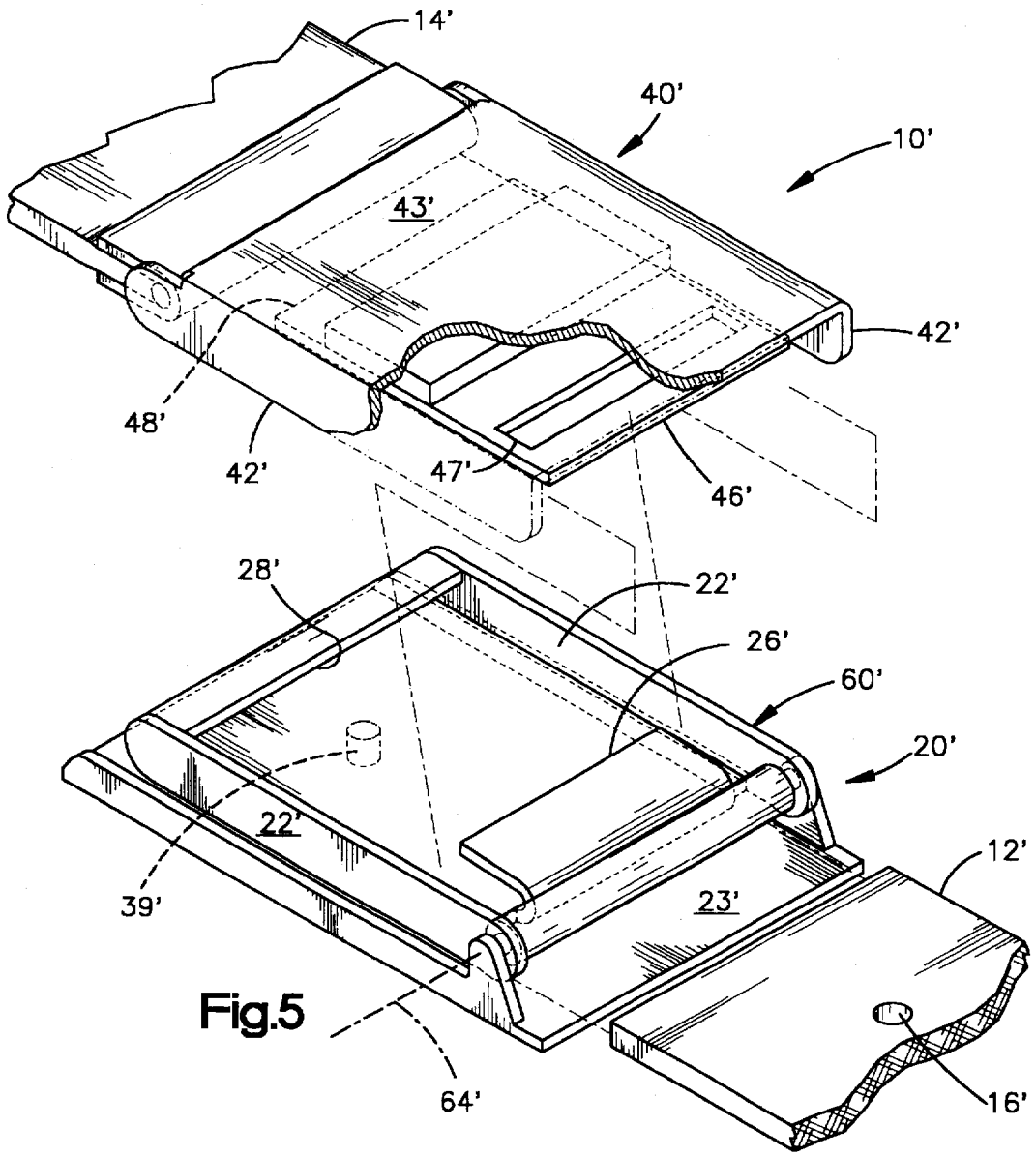
FIG. 5 shows the two elements of a second embodiment of the present invention in a perspective and partial cutaway view to show various parts thereof.
Figure 10:
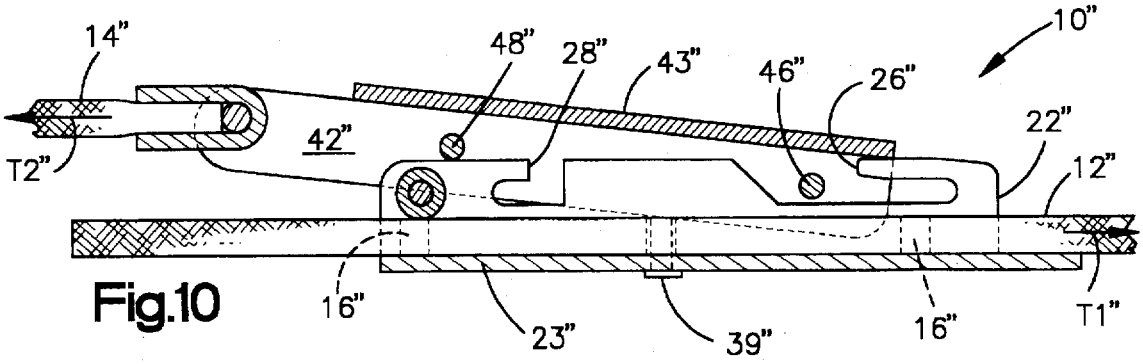
FIG. 10 shows the two elements of the third embodiment of the present invention in partial engagement with neither hook engaged.
Figure 11:
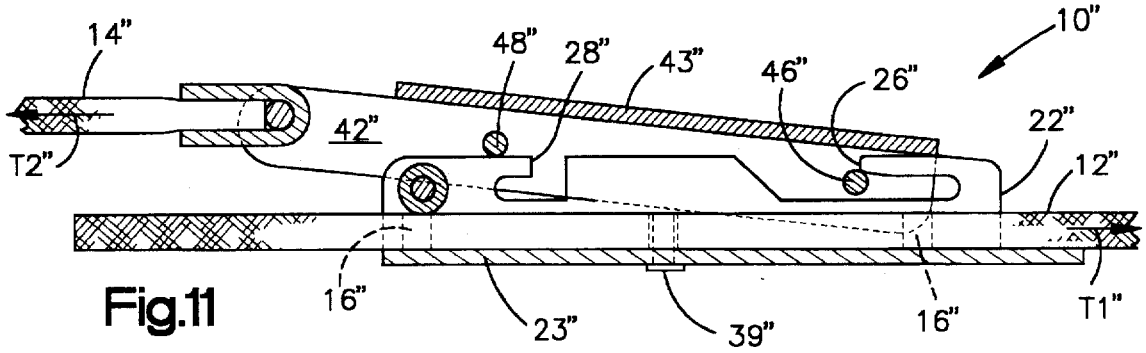
FIG. 11 shows the two elements of the third embodiment of the present invention in partial engagement with the first hook partially engaged.
Figure 12:
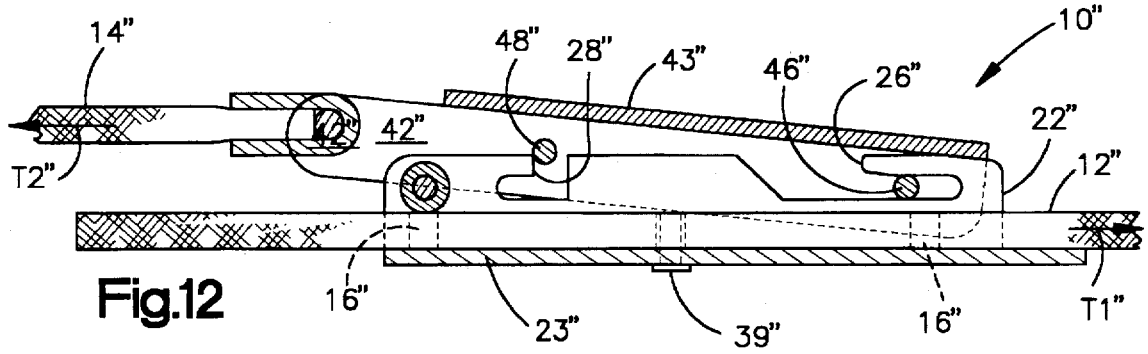
FIG. 12 shows the two elements of the third embodiment of the present invention in partial engagement with the first hook fully engaged.
Figure 13:
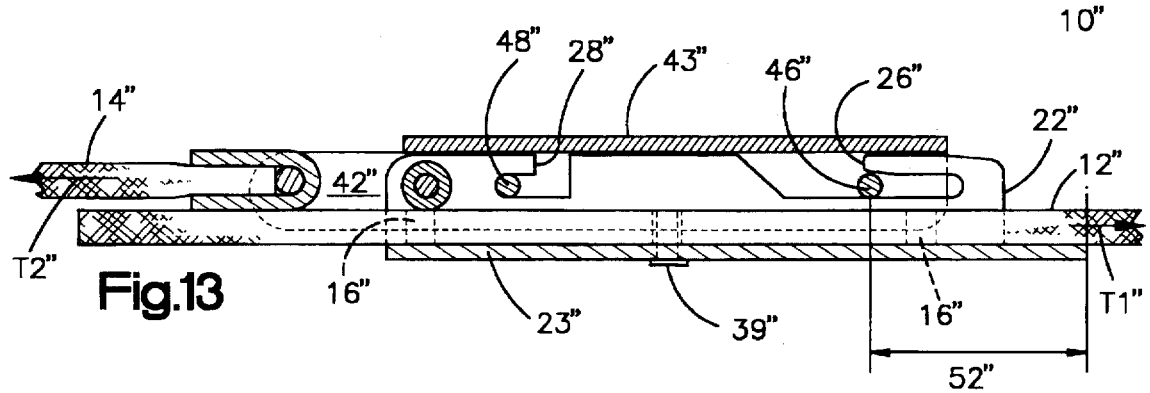
FIG. 13 shows the two elements of the third embodiment of the present invention in full engagement under tension.

The second embodiment is presented in partial cutaway perspective view in FIG. 5. Because the first and second hook-shaped members of this embodiment are parts of the bottom element of the clasp 10', we shall refer to this bottom element as the first clasp element 20'. In keeping with previous nomenclature, the first clasp element 20' is associated with and attaches to the first free end 12'. Likewise, the first and second hook-engaging members 46' and 48' of this embodiment are parts of the top element of the clasp 10', we shall refer to this top element as the second clasp element 40'. The second clasp element 40' is associated with and attaches to the second free end 14'. The importance of this nomenclature adjustment is to show that the hook-shaped members can be made a part of either the top or the bottom clasp element and still be within the teachings of this invention. It will be seen that the motion involved with engaging and disengaging the clasp remains the same, regardless of which clasp element contains the hook-shaped members.

Actually, the second embodiment is something of a hybrid showing a step in the transition from the first embodiment to the third embodiment, yet to be discussed. As shown in FIG. 5, the clasp 10' comprises a first clasp element 20' that is now the bottom clasp element attached to a first free end 12', and a second clasp element 40' attached to a second free end 14'. The second clasp element 40' has side walls 42' integral with a top wall 43', thereby to form a cover that provides a smooth and neat appearance as it engages and encloses the first clasp element 20' or base. The first clasp element has a flat bottom 23' and opposing side walls 22'.

In the illustration showing this embodiment, the second free end 14' is shown hingedly attached to the second clasp element 40'. The first free end 12' is shown to be in engagement with the inside surface of the flat bottom 23' of the first clasp element. A post 39' projecting from the inside surface engages one of several holes or sockets 16' in the first free end 12' of the strap for security with adjustability.

The first clasp element 20' of this embodiment has a hinged hook unit 60' pivotably attached to the flat bottom 23' thereof. This hinged hook unit 60' secures the first free end 12' in engagement with the post 39' to further secure the attachment of the first free end 12' to the first clasp element 20'.

These parts of this embodiment are also seen in cross-sectional views as FIG. 6, FIG. 7, and FIG. 8. In this embodiment, the hinged hook unit 60' comprises two oppositely-directed hook-shaped members, 26' and 28', formed by bending the ends of a flat plate. This construction forms a wide, flat hook 26' that is suited to engaging a wide hook-engaging member, such as a transverse bar or pin. In the illustrated embodiment, transverse bars 46' and 48' are used. In fact, the transverse bars are structurally similar to the hook-shaped members 26 and 28 of the first embodiment. Slot 47' is present in the first hook-engaging member 46' to provide relief for the leading edge of the first hook-shaped member 26', but its presence is only incidental. The similarity between this hook-engaging member and the hook-shaped members of the first embodiment is why this embodiment seems a hybrid. This embodiment could be considered to be one comprising mating hook-shaped members on both the first clasp element 20' and the second clasp element 40'. Only the need for consistent nomenclature determines which of two mating hook-shaped members is to be called a hook-shaped member and which is to be called a hook-engaging member.

The sequence of operations to engage the clasp is illustrated in FIG. 6, FIG. 7, and FIG. 8. In use, the first clasp element 20' usually rests upon the user's wrist or is against some other surface where it is maintained by gravity or friction forces without being gripped; the second clasp element 40' may be held by gripping the opposing side walls 42'. The second clasp element 40' is held inclined to the first clasp element 20' so that the first hook-engaging member 46' may be engaged with the first hook-shaped member 26', as shown in FIG. 6. When the first hook-engaging member 46' is in full engagement with the first hook-shaped member 26', as shown in FIG. 7, the second clasp element 40' may be lowered to be in intimate contact with the first clasp element 20', as shown in FIG. 3. Tension in the two free ends in opposing directions will pull the second hook-engaging member 48' into full engagement with the second hook-shaped member 28' while the first hook-engaging member 46' is partially disengaged but not released because the first hook-shaped member 26' has a longer length than does the second hook-shaped member 46'.

The tension vector T1' representing the tension the first free end 12' exerts on the first clasp element 20' points in the same direction as the opening of the shorter, second hook-shaped member 28'. A second tension vector T2' representing the tension acting on and through the second clasp element 40' by the second free end 14' points in a direction opposite to that of the first tension vector T1'. The tension represented by these opposing vectors will maintain the clasp in an engaged state by keeping said second hook-engaging member 48' and said second hook-shaped member 28' fully engaged.

Releasing the clasp involves merely reversing the engaging operation. Gripping the first clasp element 20' and applying a force against the tension T1' in the first free end 12' allows the disengaging of the second hook-shaped member 28', thereby permitting the lifting of the first clasp element 20'.

The bottom wall 23' of the first clasp element extends a distance beyond the first hook-shaped member 26'. This apparently minor feature is important in providing a lever arm 52' to allow the generating of a torque sufficient to keep the first clasp element 20' from moving as the second clasp element 40' is lifted to disengage the second hook-shaped member 28' from the second hook-engaging member 48'.

In this embodiment the issue of lever arms is more complex than in the others because of the fact that the hook-shaped members are pivotably attached to the flat bottom 23' of the first clasp element 20'. Two lever arms are present and are important. The first is similar to the one already discussed in relation to the first embodiment, but it terminus is the pivot axis 64' of the hinged hook unit 60'. The second lever arm is between the same pivot axis 64' and a moving point of contact between the top wall 43' of the second clasp element 40' and the edge of the side walls 62' of the hinged hook unit 60' of the first clasp element 20'. The torque created by the first lever arm keeps the bottom wall 23' from pivoting and the torque created by the second lever arm keeps the hinged hook unit 60' from pivoting. Again, the construction of working models demonstrated the importance of these details that may not have been appreciated without the models.

The third embodiment of the invention illustrates the full transition from having the hook-shaped members in the cover element to having the hook-shaped members in the base element, with no ambiguity as to which is the hook-shaped member and which is the hook-engaging member. This transition has been included to show that, regardless of which clasp element carries the hook-shaped members and which clasp element carries the hook-engaging members, the motion of engaging and disengaging the clasp is the same.

This third embodiment is illustrated in partial cutaway view in FIG. 9 and in cross-sectional views in FIG. 10, FIG. 11, FIG. 12, and FIG. 13. The construction of the clasp of the third embodiment is quite simple. The first clasp element 20" or base element is made up of a bottom wall 23" having attached side walls 22", each of which has cutout slots that create the throat portions of two opposing hook-shaped members 26" and 28", one being longer than the other. Other slot shapes could be used while keeping with the teachings of this embodiment. In fact, other hook-shaped members could be used while keeping with the teachings of this embodiment.

Provisions are present for adjustably attaching the base element to a first free end 12" of a watchband. In this case, there is present a transverse pin 44" under which the first free end 12" is inserted, thereby to frictionally engage the free end 12". The post 39" shown centrally located in the bottom wall 23" engages one of several holes 16" or sockets in the first free end 12" to provide a secure and adjustable attachment means.

In the illustration showing this embodiment, the second free end 14" is shown hingedly attached to the second clasp element 40". Such strap attachments are common in the art.

The second clasp element 40" includes a top wall 43" contiguous with two side walls 42" that cover the first clasp element when the clasp is fully engaged, thereby to present a smooth, neat appearance to the clasp. In this embodiment the hook-engaging members 46" and 48" are shown as simple transverse pins as have been previously described. Such simple fixed pins are preferred, but the invention could be practiced using removable spring pins engaging holes or sockets in the side walls 42". Other hook-engaging members could be used while keeping with the teachings of this embodiment.

The relative motion of the second clasp element 40" relative to the first clasp element 20" should be familiar to the reader by now. The cover element, which in this case is the second clasp element 40", is inclined to the plane of the base element, which in this case is the first clasp element 20", to engage the first hook-shaped member 26" with its corresponding hook-engaging member 46". Then the engagement is made more complete until the second hook-engaging member 48" can engage the second hook-shaped member 28" and the cover element may be lowered so the tension in the band can urge the second hook-engaging member 48" into full engagement with the second hook-shaped member 28". The longer length of the first hook-shaped member 26" maintains the partial engagement thereof with the first hook-engaging member 46" when the second hook-engaging member 48" is fully engaged with the second hook-shaped member 28". The tension keeps the clasp fully engaged while it is in use.

The tension vector T1" representing the tension the first free end 12" exerts on the first clasp element 20" points in the same direction as the opening of the shorter, second hook-shaped member 28". A second tension vector T2" representing the tension acting on and through the second clasp element 40" by the second free end 14" points in a direction opposite to that of the first tension vector T1". The tension represented by these opposing vectors will maintain the clasp in an engaged state by keeping said second hook-engaging member 48" and said second hook-shaped member 28" fully engaged.

Releasing the clasp involves merely reversing the engaging operation. Gripping the first clasp element 20" and applying a force against the tension T1" in the first free end 12" allows the disengaging of the second hook-shaped member 28", thereby permitting the lifting of the first clasp element 20".

The bottom wall 23" of the first clasp element 20" extends a distance beyond the first hook-shaped member 26". This apparently minor feature is important in providing a lever arm 52" that allows the creation of a torque sufficient to keep the first clasp element 20" from moving as the second clasp element 40" is lifted to disengage the second hook-shaped member 28" from the second hook-engaging member 48".

The above-disclosed invention has several particular features that are best practiced in concert, although each is useful individually, without departure from the scope of the invention. I have merely described preferred embodiments of the invention and it will be understood that the invention may be embodied otherwise than as herein illustrated and described. The scope of the invention should be determined by the appended claims and their legal equivalents, rather than by the specific examples given.

I claim:

1. A closure for connecting a first and a second free end of a band as might be used as a strap on a wrist watch wherein in use said closure is maintained in tension by hoop stresses imposed on the band by the banded object, said closure comprising:

a. a first clasp element adapted for attachment to said first free end, said first free end applying a first tension to said first clasp element, and having a first hook member and a second, oppositely-directed and shorter hook member, the opening of said shorter hook member being directed in the direction of said first tension; and b. a separable second clasp element adapted for attachment to said second free end, said second free end applying a second tension to said second clasp element in a direction opposite that of said first tension, and having a first hook-engaging member for slidably and releasably engaging said first hook member and, longitudinally spaced away from said first hook-engaging member, a second hook-engaging member for slidably and releasably engaging said second hook member, such hook-engaging members disposed in such positions that the engagement of both hook members with their respective hook-engaging members is possible only by first engaging said first hook member with the corresponding first hook-engaging member; sliding said first hook-engaging member deep into the throat of said first hook member, then engaging said second hook member with said second hook-receiving member while partially disengaging said first hook-engaging member from said first hook member, wherein one said clasp element comprises opposing side walls joined by a top wall, thereby forming a cover that provides a smooth and neat appearance as it engages the second said clasp element and wherein said opposing tensions acting through said first and second clasp elements maintain complete engagement of said second hook while the partial engagement of said first hook maintains said first and second elements in close alignment.

2. The closure as described in claim 1 wherein said second clasp element has opposing side walls and a said hook-engaging member is a transverse pin extending from one side wall to the other.

3. The closure as described in claim 1 wherein said first clasp element comprises a transversely-hinged hook unit pivotably attached, said hook unit having two oppositely-directed hook-shaped members.

4. The closure as described in claim 1 wherein said a said hook-engaging member has the shape of a hook.

5. The closure as described in claim 1 wherein a said hook-engaging member comprises a flat spacer affixed to an inner surface of a flat wall of said second clasp element and a longer flat plate affixed to said spacer to form a transversely-elongated hook-shaped hook-engaging member.

6. The closure as described in claim 1 wherein said first clasp element has two opposing side walls each of which has a cutout portion forming the opening of a hook-shaped member the opening of which is directed in the direction of said second tension, which two hook-shaped members in combination act as a single transversely-elongated said first hook member.

7. The closure as described in claim 1 wherein said first clasp element has two opposing side walls each of which has a cutout portion forming the opening of a hook-shaped member the opening of which is directed in the direction of said first tension, which two hook-shaped members in combination act as a single transversely-elongated said second hook member.

8. A closure for connecting a first and a second free end of a band as might be used as a strap on a wrist watch wherein in use said closure is maintained in tension by hoop stresses imposed on the band by the banded object, said closure comprising:

c. a first clasp element adapted for attachment to said first free end, said first free end applying a first tension to said first clasp element, and having a first hook member and a second, oppositely-directed and shorter hook member, the opening of said shorter hook member being directed in the direction of said first tension; and d. a separable second clasp element adapted for attachment to said second free end, said second free end applying a second tension to said second clasp element in a direction opposite that of said first tension, and having a first hook-engaging member for slidably and releasably engaging said first hook member and, longitudinally spaced away from said first hook-engaging member, a second hook-engaging member for slidably and releasably engaging said second hook member, such hook-engaging members disposed in such positions that the engagement of both hook members with their respective hook-engaging members is possible only by first engaging said first hook member with the corresponding first hook-engaging member; sliding said first hook-engaging member deep into the throat of said first hook member, then engaging said second hook member with said second hook-receiving member while partially disengaging said first hook-engaging member from said first hook member, wherein said opposing tensions acting through said first and second clasp elements maintain complete engagement of said second hook while the partial engagement of said first hook maintains said first and second elements in close alignment, and wherein said first hook member comprises a flat spacer affixed to an inner surface of a flat wall of said first clasp element and a longer flat plate affixed to said spacer to form a transversely-elongated hook-shaped member the opening of which is directed in the direction of said second tension.

9. A closure for connecting a first and a second free end of a band as might be used as a strap on a wrist watch wherein in use said closure is maintained in tension by hoop stresses imposed on the band by the banded object, said closure comprising:

e. a first clasp element adapted for attachment to said first free end, said first free end applying a first tension to said first clasp element, and having a first hook member and a second, oppositely-directed and shorter hook member, the opening of said shorter hook member being directed in the direction of said first tension; and f. a separable second clasp element adapted for attachment to said second free end, said second free end applying a second tension to said second clasp element in a direction opposite that of said first tension, and having a first hook-engaging member for slidably and releasably engaging said first hook member and, longitudinally spaced away from said first hook-engaging member, a second hook-engaging member for slidably and releasably engaging said second hook member, such hook-engaging members disposed in such positions that the engagement of both hook members with their respective hook-engaging members is possible only by first engaging said first hook member with the corresponding first hook-engaging member; sliding said first hook-engaging member deep into the throat of said first hook member, then engaging said second hook member with said second hook-receiving member while partially disengaging said first hook-engaging member from said first hook member, wherein said opposing tensions acting through said first and second clasp elements maintain complete engagement of said second hook while the partial engagement of said first hook maintains said first and second elements in close alignment, and wherein said second hook member comprises a flat spacer affixed to an inner surface of a flat wall of said first clasp element and a longer flat plate affixed to said spacer to form a transversely-elongated hook-shaped member the opening of which is directed in the direction of said first tension.

* * * * *